US007794290B1

(12) United States Patent
Joffe et al.

(10) Patent No.: US 7,794,290 B1
(45) Date of Patent: Sep. 14, 2010

(54) COMMUNICATIONS CONNECTOR CONFIGURED FOR LOW CROSSTALK

(75) Inventors: Daniel M. Joffe, Owens Crossroads, AL (US); Jeremy Harris, Eva, AL (US)

(73) Assignee: Adtran, Inc., Huntsville, AL (US)

( * ) Notice: Subject to any disclaimer, the term of this patent is extended or adjusted under 35 U.S.C. 154(b) by 0 days.

(21) Appl. No.: 12/506,285

(22) Filed: Jul. 21, 2009

(51) Int. Cl.
*H01R 13/04* (2006.01)

(52) U.S. Cl. ..... 439/692

(58) Field of Classification Search ..... 439/692, 439/670.03–607.16
See application file for complete search history.

(56) References Cited

U.S. PATENT DOCUMENTS

| | | | | | |
|---|---|---|---|---|---|
| 5,037,330 | A * | 8/1991 | Fulponi et al. | 439/607.23 |
| 5,618,185 | A * | 4/1997 | Aekins | 439/76.1 |
| 5,716,237 | A * | 2/1998 | Conorich et al. | 439/660 |
| 5,766,040 | A * | 6/1998 | Naerland et al. | 439/607.08 |
| RE36,065 | E * | 1/1999 | Andrews et al. | 439/607.11 |
| 5,864,089 | A * | 1/1999 | Rainal | 174/376 |
| 5,934,940 | A * | 8/1999 | Maranto et al. | 439/607.25 |
| 5,938,473 | A * | 8/1999 | Nishio et al. | 439/567 |
| 5,961,350 | A * | 10/1999 | Shiu | 439/607.01 |
| 6,065,994 | A | 5/2000 | Hashim et al. | 439/404 |
| 6,116,965 | A * | 9/2000 | Arnett et al. | 439/692 |
| 6,139,371 | A | 10/2000 | Troutman et al. | 439/676 |
| 6,165,023 | A | 12/2000 | Troutman et al. | 439/676 |
| 6,193,555 | B1 * | 2/2001 | Chang | 439/607.09 |
| 6,206,734 | B1 | 3/2001 | Liu | 439/676 |
| 6,328,602 | B1 | 12/2001 | Yamasaki et al. | 439/608 |
| 6,565,385 | B1 * | 5/2003 | Anderson et al. | 439/607.35 |
| 6,833,513 | B1 * | 12/2004 | Ahmad | 174/262 |
| 6,910,922 | B2 | 6/2005 | Haga | 439/608 |
| 7,186,149 | B2 | 3/2007 | Hashim | 439/676 |
| 7,371,118 | B2 | 5/2008 | Wu | 439/610 |
| 7,410,366 | B2 | 8/2008 | Wu | 439/76.1 |
| 7,435,107 | B2 | 10/2008 | Masumoto et al. | 439/79 |
| 7,438,583 | B2 | 10/2008 | AbuGhazaleh et al. | 439/344 |
| 7,459,985 | B2 | 12/2008 | Mellitz et al. | 333/5 |

* cited by examiner

*Primary Examiner*—T C Patel
*Assistant Examiner*—Vladimir Imas
(74) *Attorney, Agent, or Firm*—Allen, Dyer, Doppelt, Milbrath & Gilchrist, P.A.

(57) ABSTRACT

A communications connector includes an electrically non-conductive connector body having a terminal face. A plurality of connector terminals are positioned on the terminal face and arranged in a plurality of Tip/Ring terminal pairs, which are positioned substantially linearly with each other along the terminal face and arranged in alternating vertical and horizontal orientation of Tip/Ring terminal pairs and spaced to each other such that crosstalk among the Tip/Ring terminal pairs is cancelled.

23 Claims, 8 Drawing Sheets

COMMUNICATIONS CONNECTOR CONFIGURED FOR LOW CROSSTALK

FIELD OF THE INVENTION

This invention relates to communications connectors, and more particularly, to communications connectors that are configured for low crosstalk.

BACKGROUND OF THE INVENTION

In some communications systems, communications signals transmit video, audio and data signals over a pair of wires typically referred to as a "wirepair" or "differential pair" in which a voltage difference exists between wires to form the transmitted signal. Each wire in this wire pair typically picks up some electrical noise. If each wire in the pair picks up the same noise voltage, then differential recovery of the signal voltage cancels the common mode noise voltage. Typically, making both noise voltages the same requires closely spaced differential pairs of wires. Electrical noise is sometimes picked up from nearby wires or pairs of wires forming what is termed "crosstalk." It is a common problem with many different modular plugs and other jacks and communications connectors.

Communications connectors have been designed with different configurations as an aid in reducing crosstalk while allowing high density signal communications, i.e., having a high signal throughput on many separate communication circuits all located within a small space. Some of these communications connectors are modular jacks that use cross-coupling configurations similar to twisted pair wires to generate crosstalk-canceling signals. Other connector configurations separate the input conductors to produce crosstalk cancellation by crossing input and output conductors. Other connector designs use additional conductors to cancel crosstalk or a pair of mating or crossover conductors to cancel crosstalk. It is also possible to add chip capacitors to cancel crosstalk, vary the distance between conductors, or incorporate extra grounds or shields to reduce crosstalk.

In one proposal, a communications connector has connective terminals configured in different planes with different separation distances from midpoints of first and second pairs of terminals. A third pair of terminals is aligned in another plane that could be perpendicular to first and second planes to reduce crosstalk.

Reducing crosstalk is especially desirable for customer satisfaction when the connectors are used in Customer Premises Equipment (CPE). For example, many residential and business customers use Asymmetric Digital Subscriber Line (ADSL) and Very High Bit Rate DSL (VDSL) communications systems that typically use twisted pairs of copper wires for carrying signals within different frequency channels termed "bins." Achieving high data transmission rates with low error rates and latency requires that the cabling system adds minimal crosstalk. Low crosstalk must be maintained in all parts of the systems, including the connectors at the ends of the cable.

SUMMARY OF THE INVENTION

A communications connector includes an electrically non-conductive connector body having a terminal face. A plurality of connector terminals are positioned on the terminal face and arranged in a plurality of Tip/Ring terminal pairs, which are positioned substantially linearly with each other along the terminal face and arranged in alternating vertical and horizontal orientation of Tip/Ring terminal pairs and spaced to each other such that crosstalk among the Tip/Ring terminal pairs is cancelled.

Each Tip/Ring pair in one aspect comprises a pair of wire conductors that extend through the connector body and exit therefrom as connector pins for respective Tip/Ring terminal pairs. The connector pins are configured to enable wire wrapped connections to a printed circuit board. The connector body includes a rear face through which the Tip/Ring terminal pairs extend as connector pins. In one aspect, the connector pins extend from a rear face of the connector body and form a horizontal section followed by a riser section that extends downward from the horizontal section for engaging a circuit board to which the connector body is supported. In yet another aspect, the connector body supports at least three Tip/Ring terminal pairs along the terminal face. A female socket is formed within the terminal face at each location on the connector body at which a Tip/Ring terminal pair is located and into which a respective Tip/Ring terminal pair is positioned and into which a mating male plug can be inserted.

In yet another aspect, adjacent Tip/Ring terminal pairs are spaced such that the distance from a vertically oriented tip terminal connector on a first Tip/Ring terminal pair to a horizontally oriented tip terminal connector on a second adjacent Tip/Ring terminal pair and the distance between the ring terminal connector on the first Tip/Ring terminal pair and the tip terminal connector on the second Tip/Ring terminal pair are substantially the same distance d1. Also, the distance from the vertically oriented tip terminal connector on the first Tip/Ring terminal pair to the horizontally oriented ring terminal connector on the second Tip/Ring terminal pair and the distance between the ring terminal connector on the first Tip/Ring terminal pair and the ring terminal connector on the second Tip/Ring terminal pair are substantially the same distance d2. The distances d1 and d2 are such that crosstalk among Tip/Ring terminal pairs is cancelled.

In yet another aspect, the communications connector can be formed as a plurality of electrically non-conductive connector bodies each having a terminal face and positioned linearly and adjacent to each other. A pair of connector terminals are positioned on the terminal face of each electrically non-conductive connector body and arranged as a Tip/Ring terminal pair in one of a vertical or horizontal configuration on the terminal face. Each of the connector bodies are arranged adjacent to each other such that the Tip/Ring terminal pairs are arranged in alternating vertical and horizontal orientation and spaced to each other a distance such that the crosstalk among Tip/Ring terminal pairs is cancelled.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 4:
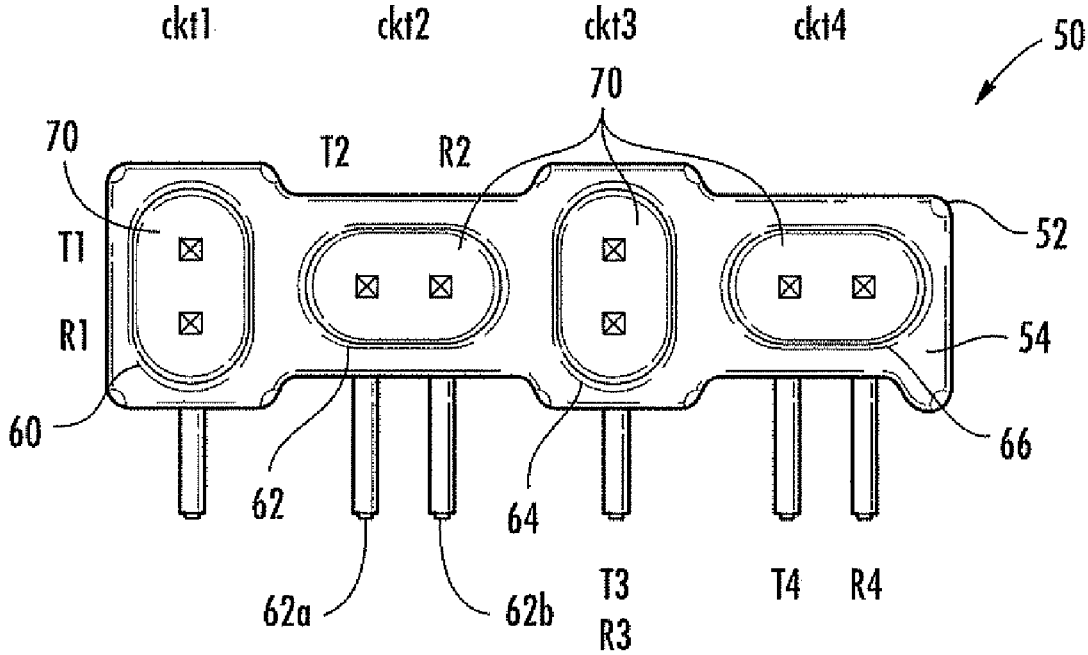
FIG. 4 is a front plan view of a communications connector in accordance with a non-limiting example and showing the alternating vertical and horizontal orientation of the connector terminal pairs forming respective Tip/Ring terminal pairs.

The communications connector, in accordance with one non-limiting aspect, has a symmetrical design configuration that uses an alternate horizontal and vertical orientation of the connector terminals forming the Tip/Ring terminal pair such as shown in FIG. 4. The connector terminals are formed as a pair of wire conductors that extend through the connector body to the printed circuit (PC) board (PCB) and form connector pins in one example. The connector terminals have a symmetric positioning to cancel differential-differential (DD) crosstalk in a riser section (vertically extending section) of the connector pin. In one non-limiting example, the connector pins are designed as wire wrap connector pins forming in this example a low crosstalk wire-wrap communications connector. Because the rate and reach of high-speed data service depends strongly upon freedom from crosstalk, the communications connector, in accordance with this non-limiting example, has a design geometry that achieves both low crosstalk and high density. Thus, the communications connector has a combination of wide bandwidth and low crosstalk on a number of circuits in a small space as an advantageous feature. For an idealized differential mode (dm) operation, crosstalk can be effectively cancelled to close to zero due to the symmetry of the design and can be used in loop connections for various ADSL and VDSL CPE products.

For the communications connector shown in FIGS. 4-8 and 8A, the crosstalk in adjacent connector terminal pairs is more than 80 dB down at 30 MHz. For reference, the UNGER NEXT model is 28 dB down at 30 MHz. A standard 50-pin miniature ribbon connector such as an Amp Champ communications connector is down about 30 dB at 30 MHz as a comparison.

Figure 1:
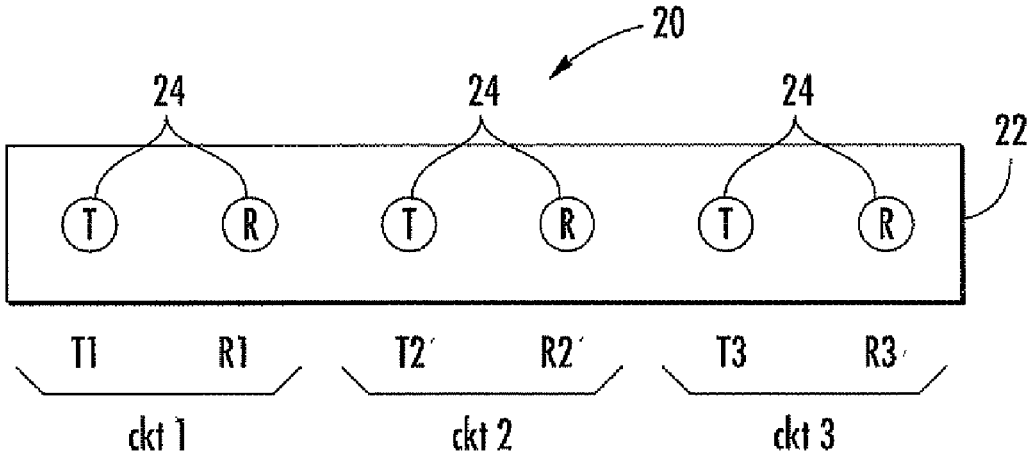
FIG. 1 PRIOR ART
FIG. 1 is a front view of an example of a prior proposal communications connector in which a row of terminals are all configured horizontally pair-wise to provide connections for three communications circuits.
Figure 2:
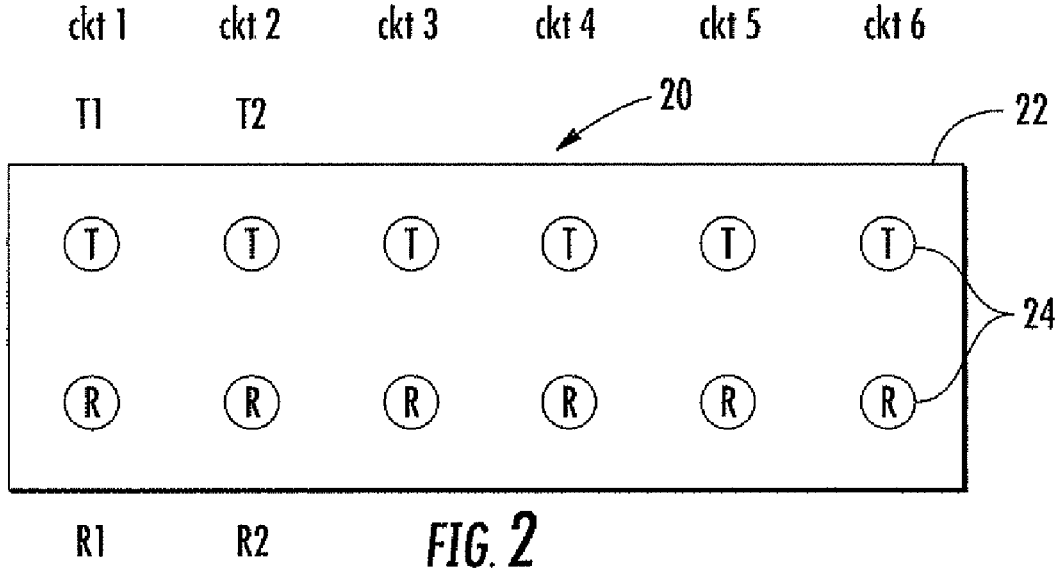
FIG. 2 PRIOR ART
FIG. 2 is another front view of a communications connector similar to the connector shown in FIG. 1, but showing an alternate arrangement of terminals with each connector pair arranged vertically.
Figure 3:
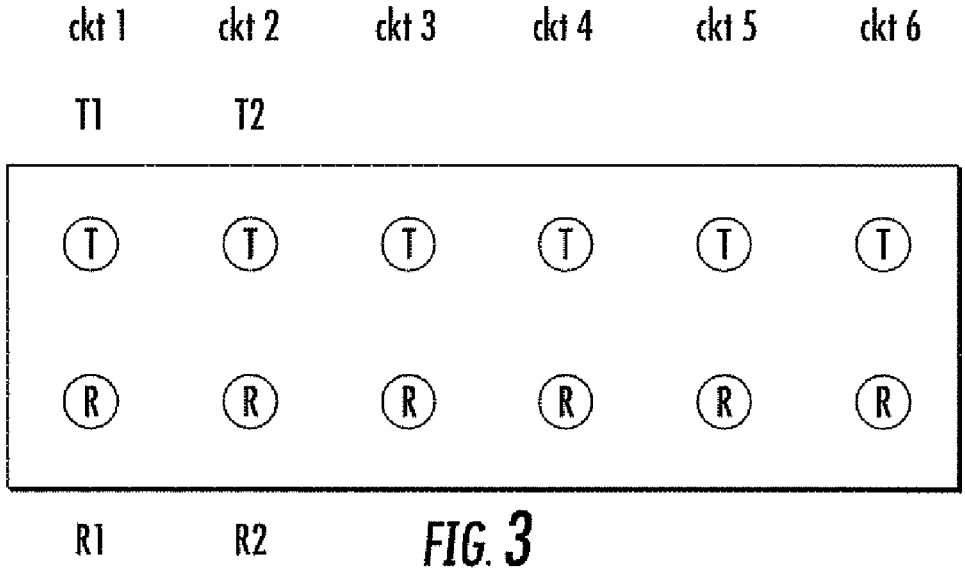
FIG. 3 PRIOR ART
FIG. 3 is another front view of a communications connector similar to the communications connector shown in FIG. 2 and showing an improvement in the configuration in which the pairs of vertically oriented terminals are arranged closer to each other as compared to the configuration shown in FIG. 2.

There now follows a basic description explaining crosstalk measurements with common mode and differential mode signals and measurements of various connector configurations such as shown in FIGS. 1-3, followed by a more detailed description of the communications connector and crosstalk measurements of its connector terminals in accordance with non-limiting aspects of the communications connector shown in FIGS. 4-8A.

To evaluate the crosstalk of a communications connector, both metallic (differential mode) and longitudinal (common mode) excitation and responses are considered. In order to reject noise, communications systems are typically configured to reject common mode noise while receiving differential signals. Furthermore, it is important to minimize the amount of differential signal from a first pair of communication wires that is conveyed by crosstalk to a second pair of communication wires. As will be explained later below, the chosen geometry used in the communications connector, in accordance with the non-limiting example shown in FIGS. 4-8A, adequately rejects various forms of crosstalk. The illustrated connector configuration can be applied not only to a straight communications connector, but also to a rotated communications connector.

It should be understood that there are different technical aspects of common mode and differential mode signals. For a pair of wires having conductors, for example "a" and "b," it is possible to define the following quantities at any place along the length of wire:

A) $Vab(dm)=Va-Vb$, known as the differential mode or metallic voltage; and

B) $Vab(cm)=(Va+Vb)/2$, known as the common mode or longitudinal voltage.

To minimize crosstalk, communications systems typically generate and respond to differential mode signals. If the communications systems generate or respond to common mode signals, this is typically done only for low frequencies where crosstalk is less prevalent. This limits the bandwidth of the common mode portion of the channel.

FIG. 1 shows a communications connector 20 having a connector body 22 and a row of connector terminals 24 configured pair-wise and in a horizontal configuration to provide connections for three communications circuits labeled ckt1, ckt2, and ckt3. Each terminal pair is formed by Tip and Ring "pins" or connector terminals and encased in the connector body typically formed as a dielectric to aid in reducing "arcing" between the pins or terminals. Each Tip and Ring (T/R)

pair is given a pair-wise designation as a circuit (ckt) and identified as ckt1, ckt2 and ckt3.

To measure crosstalk in this example prior art communications connector, four connector terminal aspects are typically specified: (1) aggressor; (2) victim; (3) common mode excitation or reception; and (4) differential mode excitation or reception. The response of a victim to the aggressor depends upon both capacitive and inductive coupling. The strength of those responses is inversely proportional to distance, e.g., larger separations between aggressor and victim produce smaller responses in the victim than do smaller separations. There is typically some non-unity power involved in this relationship and the measurements as described assume a simple inverse relationship with distance to gain intuition about the crosstalk mechanisms.

If one unit of voltage is applied to a circuit, which includes the communications connector, this results in a current flow of one unit of current. The responses are linear with respect to the applied input. This allows use of superposition to facilitate the calculations. To gain intuition about the process, it is possible to note the decrease in crosstalk with increasing distance by a reciprocal relationship. The exact nature of the relationship is not critical, however. The geometry in the communications connector imposes a number of equal distances, which lead to equal and cancelling crosstalk signals.

By this inverse distance assumption, the excitation (Vin) and response (Vout) are related by:

$$\frac{Vout}{Vin} = \frac{kd}{|\text{distance_out_to_in}|}$$

To maintain the dimensionless nature on both sides, kd is applied a distance constant to the right side of the equation. Between ckt1 and ckt2 in the example of the communications connector of FIG. 1, there are four cases to consider:

Case 1—excite ckt1 with dm excitation, observe ckt2 dm response;

Case 2—excite ckt1 with dm excitation, observe ckt2 cm response;

Case 3—excite ckt1 with cm excitation, observe ckt2 dm response; and

Case 4—excite ckt1 with cm excitation, observe ckt2 cm response.

Case 1—excite ckt1 with differential mode (dm) excitation, observe ckt2 dm response:

Apply +Va/2 to T1 and −Va/2 to R1, for a differential mode voltage of Va. If each terminal in circuit 1 is separated by a distance d from its nearest neighbor, this results in a differential response Vout2_dm on ckt2. If in the communications connector of FIG. 1, all the terminals are separated by d, then:

$$\text{Vout2_dm} = \text{V_T2} - \text{V_R2} = \left[\frac{Va}{2}\cdot\frac{1}{2\cdot d} - \frac{Va}{2}\cdot\frac{1}{d} - \left(\frac{Va}{2}\cdot\frac{1}{3\cdot d} - \frac{Va}{2}\cdot\frac{1}{2\cdot d}\right)\right]\cdot kd$$

$$\frac{\text{Vout2_dm}}{Va} = \frac{-kd}{6\cdot d}$$

Case 2—excite ckt1 with dm excitation, observe ckt2 cm response:

$$\text{Vout2_cm} = \frac{\text{V_T2} + \text{V_R2}}{2} = \frac{\left[\frac{Va}{2}\cdot\frac{1}{2\cdot d} - \frac{Va}{2}\cdot\frac{1}{d} + \left(\frac{Va}{2}\cdot\frac{1}{3\cdot d} - \frac{Va}{2}\cdot\frac{1}{2\cdot d}\right)\right]\cdot kd}{2}$$

$$\frac{\text{Vout2_cm}}{Va} = \frac{-kd}{6}\cdot\frac{1}{d}$$

Case 3—excite ckt1 with cm excitation, observe ckt2 dm response. Apply +Va to T1 and Va to R1, for a common mode voltage of Va.

$$\text{Vout2_dm} = \text{V_T2} - \text{V_R2} = \left[Va\cdot\frac{1}{2\cdot d} + Va\cdot\frac{1}{d} - \left(Va\cdot\frac{1}{3\cdot d} + Va\cdot\frac{1}{2\cdot d}\right)\right]\cdot kd$$

$$\frac{\text{Vout2_dm}}{Va} = \frac{2\cdot kd}{3\cdot d}$$

Case 4—excite ckt1 with cm excitation, observe ckt2 cm response:

$$\text{Vout2_dm} = \text{V_T2} - \text{V_R2} = \left[Va\cdot\frac{1}{2\cdot d} + Va\cdot\frac{1}{d} + \left(Va\cdot\frac{1}{3\cdot d} + Va\cdot\frac{1}{2\cdot d}\right)\right]\cdot kd$$

$$\frac{\text{Vout2_cm}}{Va} = \frac{7}{3}\cdot\frac{Va}{d}\cdot kd$$

Less crosstalk could be obtained by decreasing the distance between the connector terminals in each pair while simultaneously increasing the distance between respective pairs of connector terminals. This configuration change decreases the overall crosstalk. In addition, this configuration change makes the distances between a given aggressor and victim more nearly equal, which can lead to beneficial crosstalk cancellation. This technique, however, suffers potential limitations:

1) the conductors or connector terminals of a pair can only be so close while still allowing adequate insertion space for wire wrap connections and sufficient breakdown voltage; and 2) wider spacing between the respective pairs may decrease density in an undesirable fashion.

The changed configuration of the communications connector shown in FIG. 2 (using the vertical orientation of the respective pairs of connector terminals), while potentially better than the communications connector configuration in FIG. 1 in some respects, is still not as adequate as the communications connector in accordance with non-limiting examples, such as shown in FIGS. 4-8.

FIG. 3 shows a communications connector configuration that improves upon the communications connector configuration shown in FIG. 2 by moving the respective pairs of connection terminals forming the conductors closer, thus increasing the potential for crosstalk cancellation. There are still functional limitations in this configuration, however.

Referring now to FIGS. 4-8 and 8A, the communications connector in accordance with one non-limiting example is shown at 50. The communications connector 50 includes a substantially rectangular configured connector body 52 (although other configurations are possible) having a front or terminal face 54 in front plan view as illustrated and supporting four connector terminals as Tip/Ring terminal pairs 60, 62, 64, 66 positioned in alternating vertical, horizontal, vertical and horizontal configuration. Each connector terminal pair 60, 62, 64, 66 is formed by two respective wire conductors, also termed connector pins, and illustrated by the respective connector pins such as 62*a*, 62*b* to form respective Tip/Ring terminal pairs are illustrated. Each Tip/Ring terminal pair comprises a pair of conductive wires that extend through the connector body 52 and form the connector pins used in wire wrapping applications in this non-limiting example. Four Tip/Ring terminal pairs 60, 62, 64, 66 are illustrated, but any number "n" of Tip/Ring terminal pairs could be used and supported within the connector body as long as the alternating vertical and horizontal configuration is used. Typically, at least two Tip/Ring terminal pairs are used.

Figure 7:
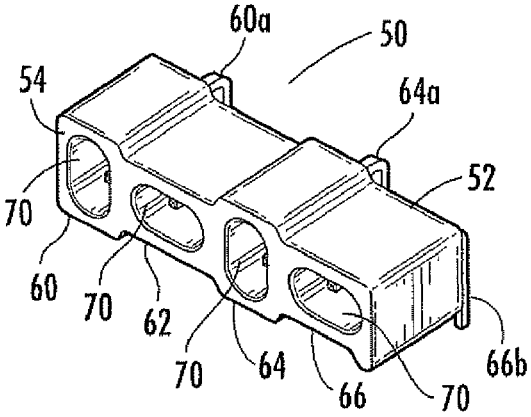
FIG. 7 is a front perspective view of the communications connector shown in FIG. 4 in accordance with a non-limiting example.

The connector body 52 is formed typically from a dielectric material to prevent arcing between connector terminals and provide mechanical stability. Each Tip/Ring terminal pair 60, 62, 64, 66 is supported by the connector body and a female socket 70 also termed a terminal socket for each Tip/Ring terminal pair is formed within the terminal face 54. The ends of a respective Tip/Ring terminal pair are positioned within a respective socket 70 and permit insertion of a mating male connector plug or similar cable or other connector into the respective connector terminal pair positioned within the terminal socket. As shown in the front plan view of FIG. 4 and the perspective view of FIG. 7, each socket 70 is substantially oval shaped and as best seen in FIG. 7, each socket 70 extends into the connector body 52 to form an opening within the connector body into which a mating male connector plug or similar cable connector can be inserted. Thus as illustrated, each respective Tip/Ring terminal pair is turned ninety (90) degrees in orientation from an adjacent Tip/Ring terminal pair. It should also be understood that although only one connector body 52 is illustrated having four different Tip/Ring terminal pairs within the connector body.

Figure 5:
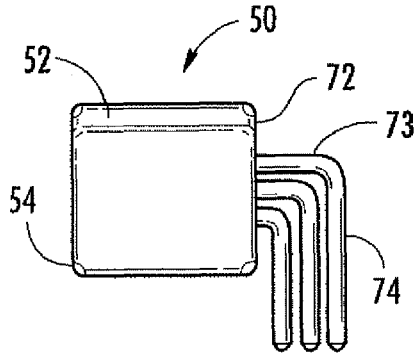
FIG. 5 is a side elevation view of the communications connector shown in FIG. 4 in accordance with a non-limiting example.
Figure 6:
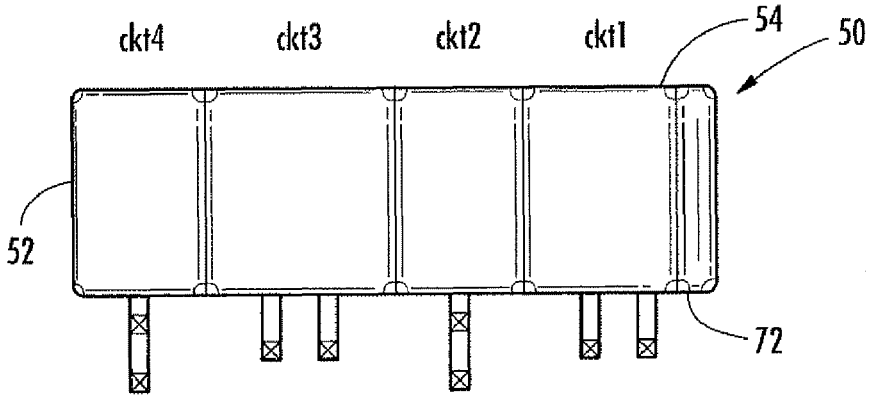
FIG. 6 is a top elevation view of the communications connector shown in FIG. 4 in accordance with a non-limiting example.
Figure 8:
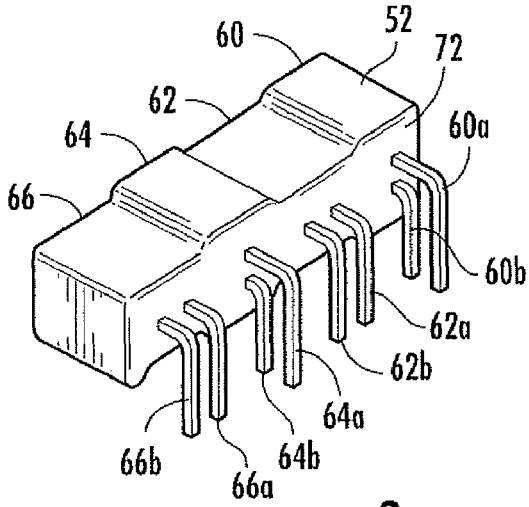
FIG. 8 is a rear perspective view of the communications connector shown in FIG. 4 in accordance with a non-limiting example.

In this non-limiting example shown in FIGS. 4-8 and 8A, the wire conductors that form the connector pins are configured as a right angle connector pin extending out the rear face 72 of the connector body such as best shown in FIGS. 5 and 8. Each connector pin has a horizontal section 73 followed by a right angle transition to a riser section 74 that extends down from the horizontal section 73 to connect into a circuit board that supports the connector body 52 for wire wrapping connection in this example. The distances between the respective connector pins in each Tip/Ring terminal pair and the distance between the respective Tip/Ring terminal pair from each other are dependent on many factors, including conductor sizes and the type of wire wrap applications. In one example, it is necessary to size the connector body and Tip/Ring terminal pair spacing to allow a wire wrap tool to engage adequately a connector pin.

In one non-limiting example, the connector body for the four Tip/Ring terminal pairs as illustrated in FIG. 4 for application to an ADSL (or VDSL) system and a wire wrapping application is about 1.7 inches long and about 0.5 inches high. These dimensions are only examples and many different configurations and dimensions can be used. Of course, this advantageous communications connector and its configuration can be used with other applications besides the described wire wrapping application.

Figure 8A:
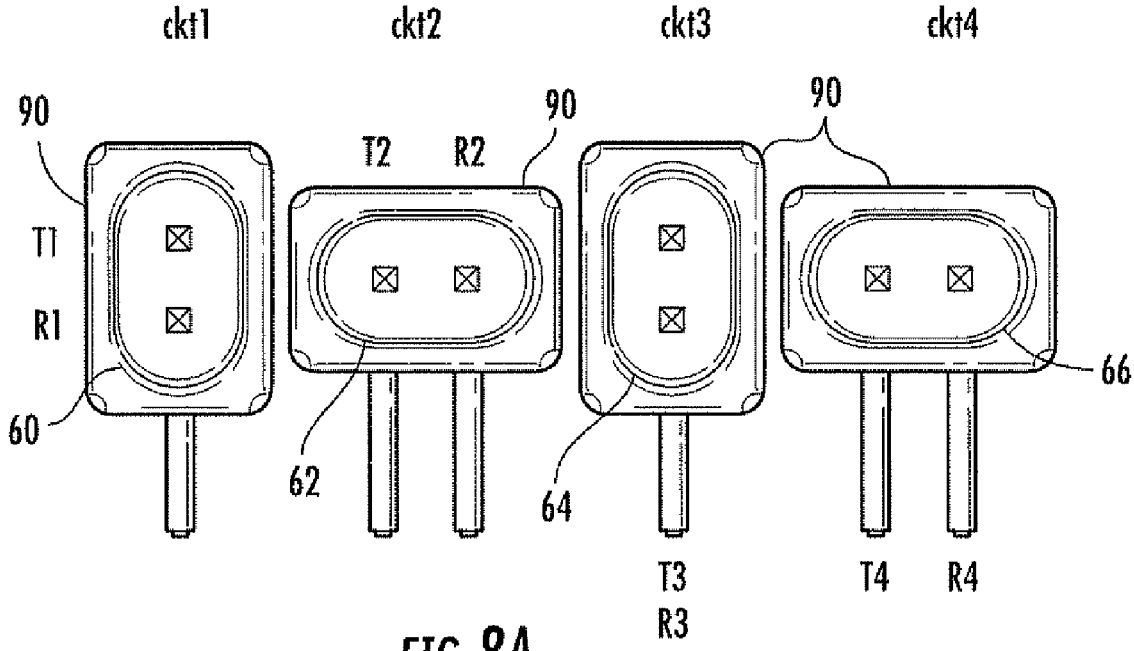
FIG. 8A is a front plan view of a communications connector similar to that shown in FIG. 4 in accordance with a non-limiting example and showing a plurality of connector bodies with each connector body having a terminal face and positioned linearly and adjacent to each other with a pair of connector terminals positioned on the terminal face and arranged as a Tip/Ring terminal pair in one of a vertical or horizontal configuration on the terminal face such that the connector bodies are arranged adjacent to each other with Tip/Ring terminal pairs arranged in alternating vertical and horizontal orientation.
Figure 9:
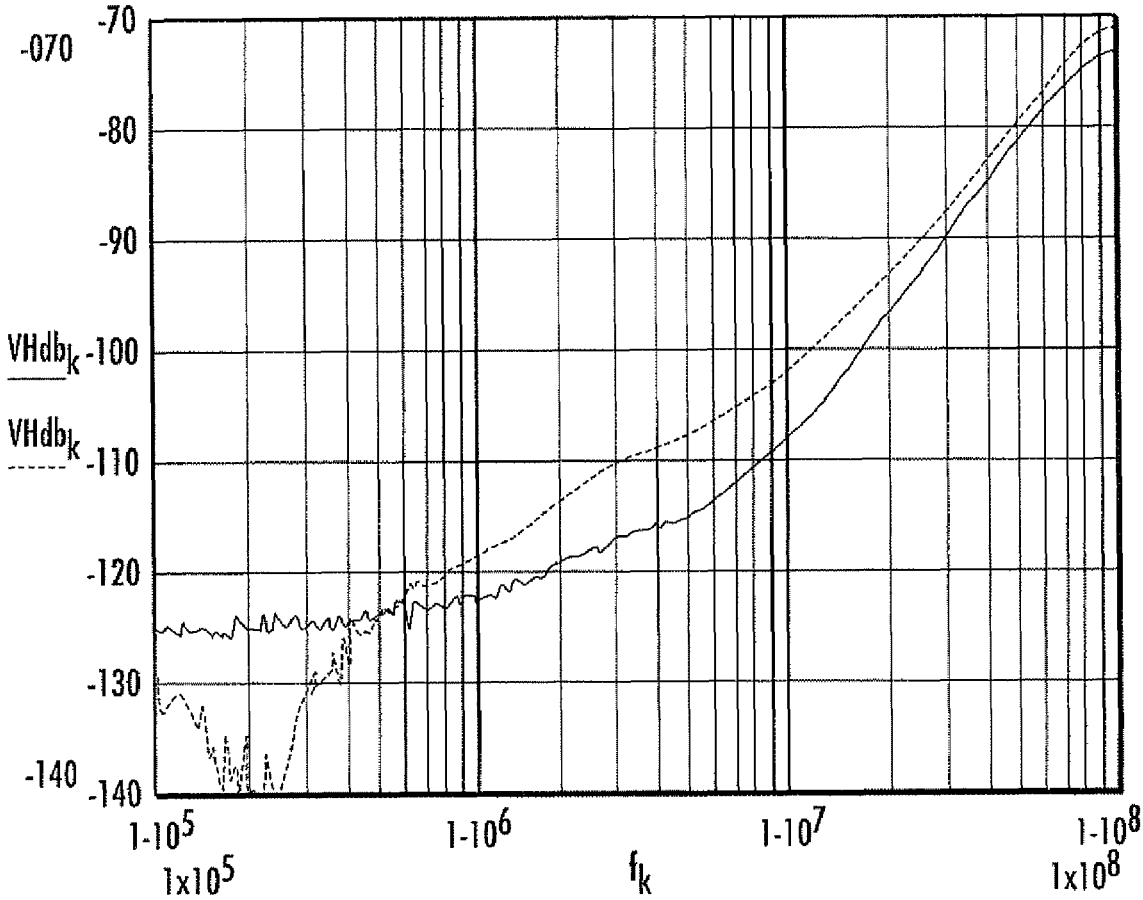
FIG. 9 is a graph showing the crosstalk in decibel versus frequency in hertz (Hz) for adjacent vertical-horizontal (VH) and horizontal-vertical (HV) for Tip/Ring terminal pairs in the communications connector shown in FIGS. 4-8 and 8A.
Figure 10:
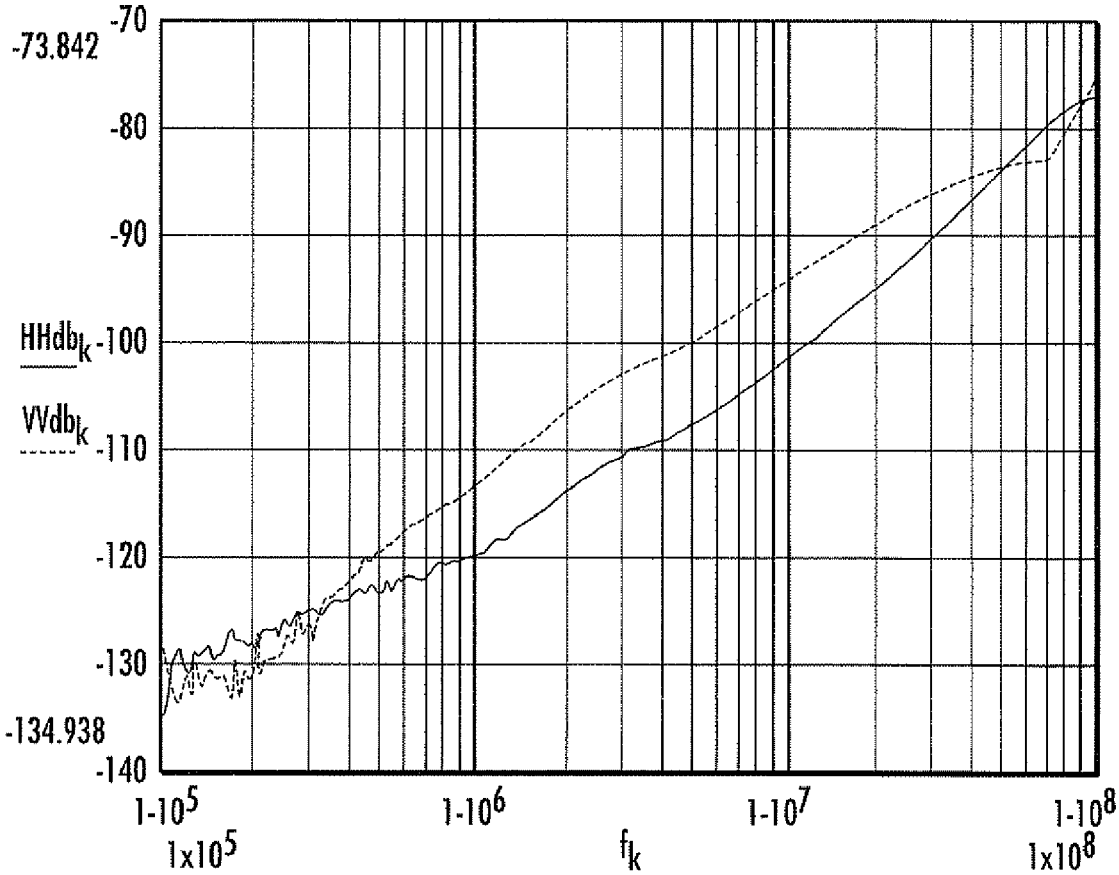
FIG. 10 is another graph showing crosstalk for adjacent horizontal-horizontal (HH) and vertical-vertical (VV) for Tip/Ring terminal pairs in the communications connector shown in FIGS. 4-8 and 8A.
Figure 11:
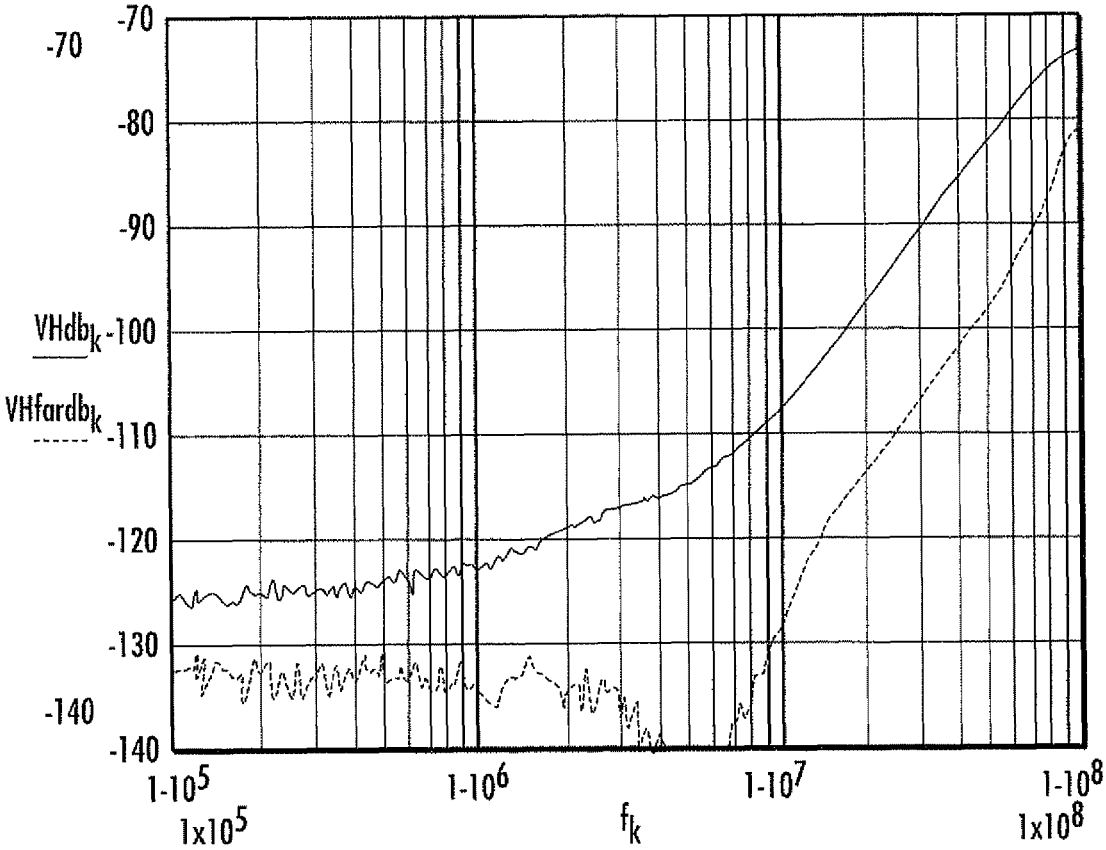
FIG. 11 is a graph showing crosstalk for separated or far VH and VH for Tip/Ring terminal pairs in the communications connector shown in FIGS. 4-8 and 8A.
Figure 12:
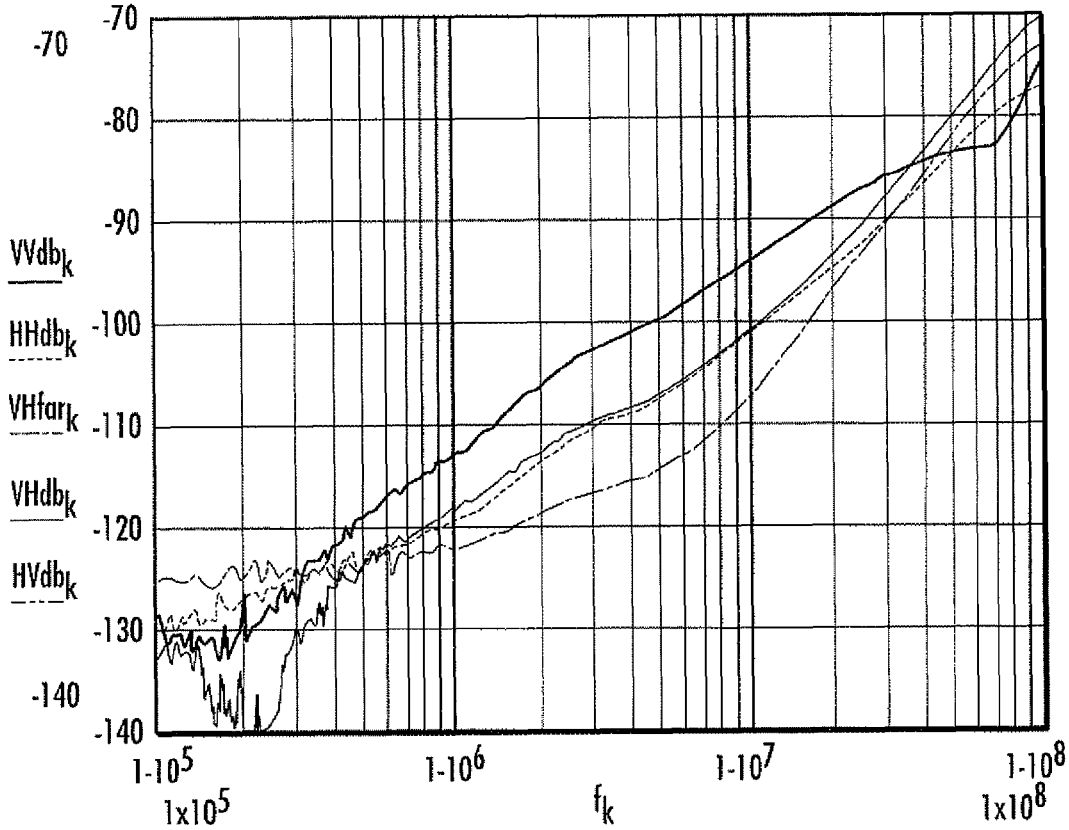
FIG. 12 is a graph showing and comparing all the measured crosstalks on one plot for the communications connector shown in FIGS. 4-8 and 8A.

FIG. 8A shows a different embodiment with a plurality of electrically non-conductive connector bodies 90 (otherwise similar reference numerals as in FIG. 4 apply) each having a terminal face 54 and positioned linearly and adjacent to each other. Each connector body 90 supports a pair of connector terminals positioned on the terminal face of each electrically non-conductive connector body and arranged as a Tip/Ring terminal pair in one of the vertical or horizontal configuration on the terminal face. As illustrated, four separate connector bodies 90 are illustrated and each of the connector bodies are arranged adjacent to each other such that the Tip/Ring terminal pairs 60, 62, 64, 66 are arranged in alternating vertical and horizontal orientation and spaced to each other a distance such that the crosstalk among the Tip/Ring terminal pairs is cancelled. The distance between the Tip/Ring terminal pair is similar to the distance shown in FIG. 4 except FIG. 4 shows the use of one connector body also termed a "shroud" and four separate connector bodies in which the connector body supports only one Tip/Ring terminal pair as illustrated in FIG. 8A.

An analysis of crosstalk measurements is now given for the communications connector of the configuration shown in FIGS. 4-8 and 8A in accordance with non-limiting examples. For cases of pair 1 to pair 2 crosstalk for this communications connector 50 are now analyzed in a manner similar to the analysis above relative to connectors shown in FIGS. 1-3.

Case 1—excite ckt1 with dm excitation and observe ckt2 dm response. Apply +Va/2 to T1 and —Va/2 to R1 in ckt1 for a differential mode voltage of Va. By the symmetry of the geometry of the communications connector 50 such as shown in FIG. 4, the following distances are the same: (a) T1 to T2 and R1 to T2, call them both d1; and (b) T1 to R2 and R1 to R2, call them both d2. This results in a differential response Vout2_dm on ckt2 given by:

$$\text{Vout2_dm} = \text{V_T2} - \text{V_R2} = \left[\frac{Va}{2}\cdot\frac{1}{d1} - \frac{Va}{2}\cdot\frac{1}{d1} - \left(\frac{Va}{2}\cdot\frac{1}{d2} - \frac{Va}{2}\cdot\frac{1}{d2}\right)\right]\cdot kd$$

$$\frac{\text{Vout2_dm}}{Va} = 0$$

Case 2—excite ckt1 with dm excitation, observe ckt2 cm response:

$$\text{Vout2_cm} = \text{V_T2} + \text{V_R2} = \left[\frac{Va}{2}\cdot\frac{1}{d1} - \frac{Va}{2}\cdot\frac{1}{d1} + \left(\frac{Va}{2}\cdot\frac{1}{d2} - \frac{Va}{2}\cdot\frac{1}{d2}\right)\right]\cdot kd$$

$$\frac{\text{Vout2_cm}}{Va} = 0$$

Case 3—excite ckt1 with cm excitation, observe ckt2 dm response:

$$\text{Vout2_dm} = \text{V_T2} - \text{V_R2} = \left[Va\cdot\frac{1}{d1} - Va\cdot\frac{1}{d1} - \left(Va\cdot\frac{1}{d2} + Va\cdot\frac{1}{d2}\right)\right]\cdot kd$$

$$\frac{\text{Vout2_dm}}{Va} = -2\cdot(-d2 + d1)\cdot\frac{kd}{d1\cdot d2}$$

Case 4—excite ckt1 with cm excitation, observe ckt2 cm response:

Vout2_dm =

-continued $$V_T2 - V_R2 = \left[Va \cdot \frac{1}{d1} + Va \cdot \frac{1}{d1} + \left(Va \cdot \frac{1}{d2} + Va \cdot \frac{1}{d2}\right)\right] \cdot kd$$

$$\frac{Vout2_cm}{Va} = 2 \cdot (-d2 + d1) \cdot \frac{kd}{d1 \cdot d2}$$

Owing to the symmetry of this communications connector 50 design as illustrated and explained above, dm-dm crosstalk is substantially perfect. The data transmission signals are carried as dm (differential mode signals), and the power in the common mode signal is negligible by design. Case 2 indicates the common mode signal resulting from differential excitation is also zero. The reciprocity theorem informs one that the calculated results are valid if the source and the receiver are swapped. Thus, these results apply for aggressors on pair 2 and receivers on pair 1 corresponding to ckt1 and ckt2.

Terminal Pair 1 to terminal Pair 3 (corresponding to ckt1 and ckt2 as Tip/Ring terminal pairs) does not have the same symmetry as Terminal Pair 1 to Terminal Pair 2, and so does not exhibit perfect crosstalk cancellation. Still, when compared with prior art connectors as analyzed above such as shown in FIGS. 1-3, Terminal Pair 1 to Terminal Pair 3 crosstalk is less, owing to its separation by Terminal Pair 2. The communications connector as described relative to FIG. 4 and its symmetry affords lower crosstalk without sacrificing density.

The communications connector shown in FIGS. 4-8 and 8A can mount directly on a PC board, with the shaft of the connector pins perpendicular to a plane of the circuit board. It is also beneficial, however, to have a right-angle connector, where the mating portion of the connector pin shaft is parallel to the plane of the PC board. If the communications connector 50 maintains the beneficial symmetry outlined in the previous section, it is possible to cancel crosstalk in the portions of the connector pins, which mate with the PC board.

The communications connector 50 can be formed to have the alternate horizontal and vertical orientations of the PC board connector pins along with a symmetric placement to cancel differential-differential crosstalk in the riser section of the connector pin. This is clearly shown in the view from below the communications connector. The riser section is defined as that part of the connector pin that rises from the PC board towards the right angle transition at the horizontal section as shown in FIGS. 5 and 8 and 8A.

The pattern as shown results in a slight asymmetry. The portion of the T1 conductor parallel to the plane of the board is slightly longer than the same portion of the R1 conductor as shown in FIG. 8. This slight asymmetry leads to imperfect crosstalk cancellation. However, this is a small source of asymmetry compare to the large asymmetries present in many previous communications connectors.

As noted before, FIGS. 4-8 and 8A show the communications connector 50 in various views. As best shown in FIGS. 4, 8 and 8A when viewed together, T1 and R1 form a first Tip/Ring terminal pair 60 with a vertical orientation and having connector pins 60*a*, 60*b*. T2 and R2 form the first Tip/Ring terminal pair 62 with a horizontal orientation and connector pins 62*a*, 62*b*. T3 and R3 form a second vertical Tip/Ring terminal pair 64 and connector pins 64*a*, 64*b*, and T4 and R4 form the second horizontal Tip/Ring terminal pair 66 and connector pins 66*a*, 66*b*.

Measurements were made for the 100-ohm crosstalk for the following cases with Vertical-Horizontal (VH); Horizontal-Vertical (HV); Vertical-Vertical (VV); Horizontal-Horizontal (HH), and for Vertical-Horizontal such as from ckt1 to ckt4 in FIG. 4 (VH far).

VH (T1-R1 to T2-R2)
HV (T2-R2 to T3-R3)
VV (T1-R1 to T3-R3)
HH (T2-R4 to T4-R4)
VHfar (T1-R1 to T4-R4)

The graphs shown in FIGS. 9-12 display the results of the crosstalk measurement. These measurements were carefully taken so that any twisted pair connections do not contribute more crosstalk than the communications connector 50 itself. For that reason, in the test set-up, a shield was used between the transmit and receive during testing. Any twisted pairs were also oriented with the terminations at right angles to each other. Finally, shielded pairs were used for the connections between the communications connector and the transformers.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A communications connector, comprising:

an electrically non-conductive connector body having a terminal face; and a plurality of connector terminals positioned on the terminal face and arranged in a plurality of Tip/Ring terminal pairs, wherein the Tip/Ring terminal pairs are positioned substantially linearly with each other along the terminal face and arranged in alternating vertical and horizontal orientation of Tip/Ring terminal pairs and spaced to each other, wherein the Tip/Ring terminal pairs of a first pair are spaced a distance D1 between the Tip terminal of an adjacent terminal pair and spaced a distance D2 between the Ring terminal of the adjacent terminal pair such that crosstalk among the Tip/Ring terminal pairs is cancelled.

2. The communications connector according to claim 1, wherein each Tip/Ring terminal pair comprises a pair of wire conductors that extend through the terminal body and exit therefrom as connector pins for respective Tip/Ring terminal pairs.

3. The communications connector according to claim 2, wherein the connector pins are configured for wire wrapping connections to a printed circuit board.

4. The communications connector according to claim 2, wherein the connector body includes a rear face through which the Tip/Ring terminal pairs extend as connector pins.

5. The communications connector according to claim 4, wherein the connector pins extending from the rear face include a horizontal section that extends from the rear face of the connector body and a riser section that extends downward from the horizontal section for engaging a circuit board to which the connector body is supported.

6. The communications connector according to claim 1, wherein the connector body supports at least three Tip/Ring terminal pairs along the terminal face.

7. The communications connector according to claim 1, and further comprising a female socket formed within the terminal face at each location on the connector body at which a Tip/Ring terminal pair is located and into which a respective Tip/Ring terminal pair is positioned and into which a mating male connector plug can be inserted.

8. A communications connector, comprising:

an electrically non-conductive connector body having a terminal face; and a plurality of connector terminals positioned on the terminal face and arranged in a plurality of Tip/Ring terminal pairs, wherein the Tip/Ring terminal pairs are positioned linearly with each other along the terminal face and arranged in alternating vertical and horizontal orientation of Tip/Ring terminal pairs, wherein an adjacent two Tip/Ring terminal pairs that are adjacent are spaced such that the distance from a vertically oriented Tip terminal connector on a first Tip/Ring terminal pair to a horizontally oriented Tip terminal connector on a second adjacent Tip/Ring terminal pair and the distance between the Ring terminal connector on the first Tip/Ring terminal pair and the Tip terminal connector on the second Tip/Ring terminal pair are substantially the same distance d1 and the distance from the vertically oriented Tip terminal connector on the first Tip/Ring terminal pair to the horizontally oriented Ring terminal connector on the second Tip/Ring terminal pair and the distance between the Ring terminal connector on the first Tip/Ring terminal pair and the Ring terminal connector on the second Tip/Ring terminal pair are substantially the same distance d2 wherein the distances d1 and d2 are such that crosstalk among Tip/Ring terminal pairs is cancelled.

9. The communications connector according to claim 8, wherein each Tip/Ring terminal pair comprises a pair of wire conductors that extend through the terminal body and exit therefrom as connector pins for respective Tip/Ring terminal pairs.

10. The communications connector according to claim 9, wherein the connector pins are configured for wire wrapping connections to a printed circuit board.

11. The communications connector according to claim 9, wherein the connector body includes a rear face through which the Tip/Ring terminal pairs extend as connector pins.

12. The communications connector according to claim 11, wherein the connector pins extending from the rear face include a horizontal section that extends from the rear face of the connector body and a riser section that extends downward from the horizontal section for engaging a circuit board to which the connector body is supported.

13. The communications connector according to claim 8, wherein the connector body supports at least three Tip/Ring terminal pairs along the terminal face.

14. The communications connector according to claim 8, and further comprising a female socket formed within the terminal face at each location on the connector body at which a Tip/Ring terminal pair is located and into which a respective Tip/Ring terminal pair is positioned and into which a mating male connector plug can be inserted.

15. A communications connector, comprising:

a plurality of electrically non-conductive connector bodies each having a terminal face and positioned linearly and adjacent to each other; and a pair of connector terminals positioned on the terminal face of each electrically non-conductive connector body and arranged as a Tip/Ring terminal pair in one of a vertical or horizontal configuration on the terminal face, wherein each of the connector bodies are arranged adjacent to each other such that the Tip/Ring terminal pairs are arranged in alternating vertical and horizontal orientation and spaced to each other a distance, wherein the Tip/Ring terminal pairs of a first pair are spaced a distance D1 between the Tip terminal of an adjacent terminal pair and spaced a distance D2 between the Ring terminal of the adjacent terminal pair such that crosstalk among the Tip/Ring terminal pairs is cancelled.

16. The communications connector according to claim 15, wherein an adjacent two connector bodies are spaced such that the distance from the vertically oriented Tip terminal connector on a first connector body to the horizontally oriented Tip terminal connector on a second adjacent connector body and the distance between the Ring terminal connector on the first connector body and the Tip terminal connector on the second connector body are substantially the same distance.

17. The communications connector according to claim 15, wherein an adjacent two connector bodies are spaced such that the distance from the vertically oriented Tip terminal connector on a first connector body to the horizontally oriented Ring terminal connector on a second adjacent connector body and the distance between the Ring terminal connector on the first connector body and the Ring terminal connector on the second connector body are substantially the same distance.

18. The communications connector according to claim 15, wherein each Tip/Ring terminal pair comprises a pair of wire conductors that extend through the respective connector body and exit therefrom as connector pins for respective Tip/Ring terminal pairs.

19. The communications connector according to claim 18, wherein the connector pins are configured for wire wrapping connections to a printed circuit board.

20. The communications connector according to claim 18, wherein each connector body includes a rear face through which the Tip/Ring terminal pairs extend as connector pins.

21. The communications connector according to claim 20, wherein the connector pins extending from the rear face include a horizontal section that extends from the rear face of the connector body and a riser section that extends downward from the horizontal section for engaging a circuit board to which each connector body is supported.

22. The communications connector according to claim 15 wherein at least three connector bodies are positioned adjacent to support at least three adjacent Tip/Ring terminal pairs.

23. The communications connector according to claim 15, and further comprising a female socket formed within each terminal face at each location on the connector body at which a Tip/Ring terminal pair is located and into which a respective Tip/Ring terminal pair is positioned and into which a mating male connector plug can be inserted.

* * * * *

UNITED STATES PATENT AND TRADEMARK OFFICE

CERTIFICATE OF CORRECTION

PATENT NO. : 7,794,290 B1
APPLICATION NO. : 12/506285
DATED : September 14, 2010
INVENTOR(S) : Joffe et al.

It is certified that error appears in the above-identified patent and that said Letters Patent is hereby corrected as shown below:

Col. 8, lines 41-49 Delete:

"

$$\text{Vout2_cm} =$$

$$\text{V_T2} + \text{V_R2} = \left[\frac{Va}{2}\cdot\frac{1}{d1} - \frac{Va}{2}\cdot\frac{1}{d1} + \left(\frac{Va}{2}\cdot\frac{1}{d2} - \frac{Va}{2}\cdot\frac{1}{d2}\right)\right]\cdot kd$$

$$\frac{\text{Vout2_cm}}{Va} = 0$$

"

Substitute:

$$\text{Vout2_cm} = \frac{\text{V_T2} + \text{V_R2}}{2} = \frac{\left[\frac{\text{Va}}{2}\cdot\frac{1}{\text{d1}} - \frac{\text{Va}}{2}\cdot\frac{1}{\text{d1}} + \left(\frac{\text{Va}}{2}\cdot\frac{1}{\text{d2}} - \frac{\text{Va}}{2}\cdot\frac{1}{\text{d2}}\right)\right]\cdot\text{kd}}{2}$$

$$\frac{\text{Vout2_cm}}{\text{Va}} = 0$$

Signed and Sealed this
Fourth Day of January, 2011

David J. Kappos

David J. Kappos
*Director of the United States Patent and Trademark Office*